US011320096B2

(12) United States Patent
Wan et al.

(10) Patent No.: US 11,320,096 B2
(45) Date of Patent: May 3, 2022

(54) WATER-PROOF AND WELD-FREE LED BULB

(71) Applicants: Huaping Wan, Guangdong (CN); Zhengkun Wan, Guangdong (CN)

(72) Inventors: Huaping Wan, Guangdong (CN); Zhengkun Wan, Guangdong (CN)

( * ) Notice: Subject to any disclaimer, the term of this patent is extended or adjusted under 35 U.S.C. 154(b) by 0 days.

(21) Appl. No.: 17/148,596

(22) Filed: Jan. 14, 2021

(65) Prior Publication Data

US 2021/0388952 A1 Dec. 16, 2021

(30) Foreign Application Priority Data

Jun. 11, 2020 (CN) ..... 202021075507.0

(51) Int. Cl.

| | |
|---|---|
| ***F21K 9/235*** | (2016.01) |
| ***F21K 9/66*** | (2016.01) |
| ***F21V 31/00*** | (2006.01) |
| ***F21V 17/12*** | (2006.01) |
| *F21Y 115/10* | (2016.01) |

(52) U.S. Cl.

CPC ..... *F21K 9/235* (2016.08); *F21K 9/66* (2016.08); *F21V 17/12* (2013.01); *F21V 31/005* (2013.01); *F21Y 2115/10* (2016.08)

(58) Field of Classification Search

CPC ..... F21V 31/00; F21V 31/005; F21K 9/235; F21K 9/232; F21K 9/233; F21K 9/237; F21K 9/238; H01R 13/11–115

USPC ..... 439/669

See application file for complete search history.

(56) References Cited

U.S. PATENT DOCUMENTS

| | | | | |
|---|---|---|---|---|
| 5,018,044 | A * | 5/1991 | Weiss | A61N 1/14 361/212 |
| 9,719,638 | B1 * | 8/2017 | Wang | F21V 19/0055 |
| 10,020,626 | B1 * | 7/2018 | Hung | F21V 23/06 |
| 2002/0037669 | A1 * | 3/2002 | D'Addario | H01R 24/58 439/669 |
| 2017/0023225 | A1 * | 1/2017 | Chen | F21K 9/238 |
| 2017/0149188 | A1 * | 5/2017 | Kaandorp | H01R 33/22 |
| 2018/0128447 | A1 * | 5/2018 | Chen | F21V 17/12 |
| 2018/0156445 | A1 * | 6/2018 | Chen | F21V 31/005 |
| 2019/0249831 | A1 * | 8/2019 | Liu | F21V 29/74 |
| 2019/0271442 | A1 * | 9/2019 | Ren | F21V 3/02 |

* cited by examiner

*Primary Examiner* — Rajarshi Chakraborty
*Assistant Examiner* — Michael Chiang
(74) *Attorney, Agent, or Firm* — Prakash Nama; Global IP Services, PLLC

(57) ABSTRACT

A water-proof and weld-free LED bulb comprises a fixing structure and a water-proof structure, wherein the fixing structure is composed of a rivet and a female terminal, an anti-skid clamping portion is arranged at the top of the rivet, and movable lock pieces are arranged on two sides of the female terminal; the water-proof structure is composed of a first water-proof rubber ring and a silica gel plug, a hole is formed in the middle of the silica gel plug, the rivet penetrates through the hole in the silica gel plug, and the anti-skid clamping portion stretches out of the other end of the hole and is clamped on and connected to the female terminal. Weld-free assembly is realized through the rivet and the female terminal, as well as the silica gel plug and the threaded structure arranged at the bottom of a lampshade, the productivity is greatly improved.

7 Claims, 7 Drawing Sheets

WATER-PROOF AND WELD-FREE LED BULB

BACKGROUND OF THE INVENTION

The invention relates to the technical field of lamps, in particular to a water-proof and weld-free LED bulb.

To reach IP65 or better water-proof performance, the lamp holder of existing LED lamps is typically filled with glue, and contacts at the bottom of the lamp holder are typically formed by iron solder. Such lamps have the following defects: the cost is high, and the glue should be heat-resistant to some extent; moreover, the lamps are difficult to disassemble and repair, and bulbs have to be replaced, leading to severe wastage; in addition, the contact solder at the bottom of the lamp holder is low in output, non-uniform in size, and difficult to control.

BRIEF SUMMARY OF THE INVENTION

The objective of the invention is to overcome the defects of the prior art by providing a water-proof and weld-free LED bulb.

The technical solution of the invention is as follows:

A water-proof and weld-free LED bulb comprises:

A fixing structure composed of a rivet and a female terminal, wherein an anti-skid clamping portion is arranged at the top of the rivet, and movable lock pieces are arranged on two sides of the female terminal;

A water-proof structure composed of a first water-proof rubber ring and a silica gel plug, wherein a hole is formed in the middle of the silica gel plug, the rivet penetrates through the hole in the silica gel plug, and the anti-skid clamping portion stretches out of the other end of the hole and is clamped on and connected to the female terminal.

In the invention, the water-proof and weld-free LED bulb further comprises a cup lamp holder, an LED lamp chip and a lampshade, wherein one end of the bottom of the LED lamp chip is connected to a wire, and a threaded structure is arranged at the bottom of the lampshade.

Furthermore, the female terminal is arranged at the bottom of the LED lamp chip, and the silica gel plug is arranged between the rivet and the LED lamp chip.

Furthermore, the first water-proof rubber ring is disposed around the bottom of the lampshade.

Furthermore, the water-proof and weld-free LED bulb further comprises a second water-proof rubber ring, wherein a top surface of the second water-proof rubber ring is flat, a bottom surface of the second water-proof rubber ring is provided with multiple circular water-proof protrusions, the top surface of the second water-proof rubber ring is attached to the silica gel plug, and the bottom surface of the second water-proof rubber ring is attached to the bottom of the cup lamp holder.

Furthermore, the rivet, the silica gel plug and the LED lamp chip are mounted in the lampshade, and the cup lamp holder is mounted on a threaded structure at the bottom of the lampshade.

Furthermore, the diameter of the silica gel plug is slightly greater than the caliber of the lampshade, and the diameter of the hole formed in the silica gel plug is slightly smaller than that of the rivet.

Furthermore, glue is smeared between the cup lamp holder and the threaded structure of the lampshade.

Furthermore, the water-proof and weld-free LED bulb further comprises a power board body, wherein the LED lamp chip is welded on the power board body, the wire is also welded on the power board body, a slot corresponding to the power board body in shape is formed in the top of the silica gel plug, and the power board body is inserted into the slot to be fixed.

Furthermore, a fool-proof point is arranged at the top of the silica gel plug and is located below the slot.

Compared with the prior art, the invention has the following beneficial effects:

Weld-free assembly is realized through the rivet and the female terminal, as well as the silica gel plug and the threaded structure arranged at the bottom of the lampshade, the productivity is greatly improved, and compared with solder, the rejection rate is drastically decreased; and the overall water-proof performance is stable through the cooperation of the silica gel plug and the first water-proof rubber ring, as well as the glue smeared between the lampshade and the cup lamp holder.

BRIEF DESCRIPTION OF THE DRAWINGS

To further clarify the technical solution of the embodiments of the invention, the drawings used for describing the embodiments of the invention or the prior art will be briefly introduced below. Obviously, the drawings in the following description are merely for some embodiments of the invention. Those ordinarily skilled in the art can obtain other drawings according to the following ones without creative labor.

Figure 6A:
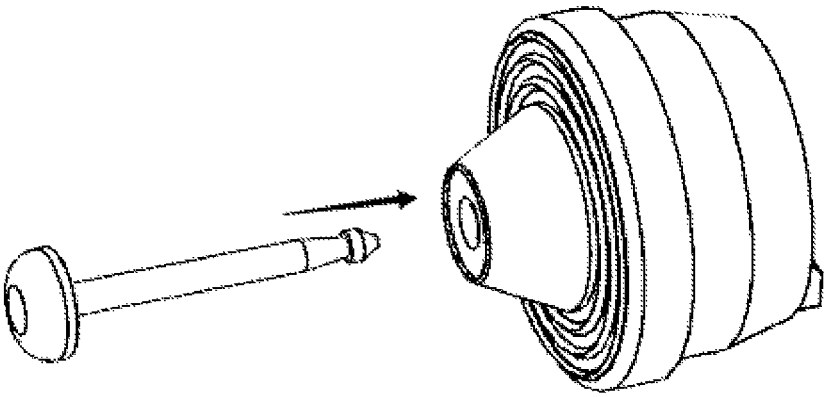
Figure 6B:
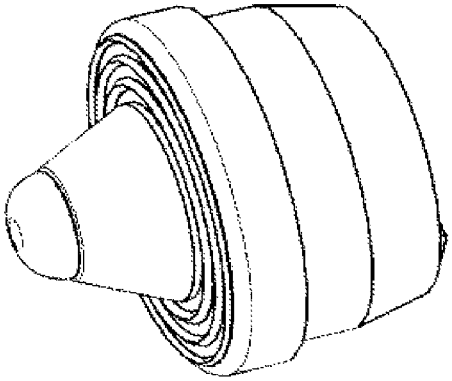
Figure 6C:
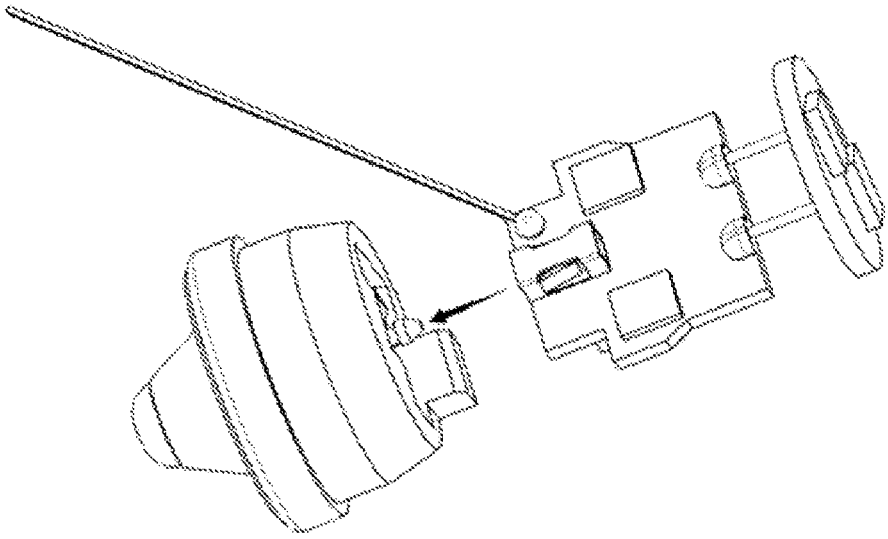
Figure 6D:
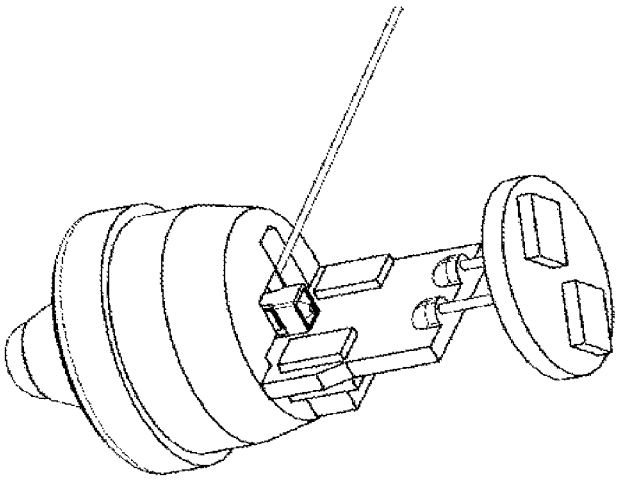
Figure 6E:
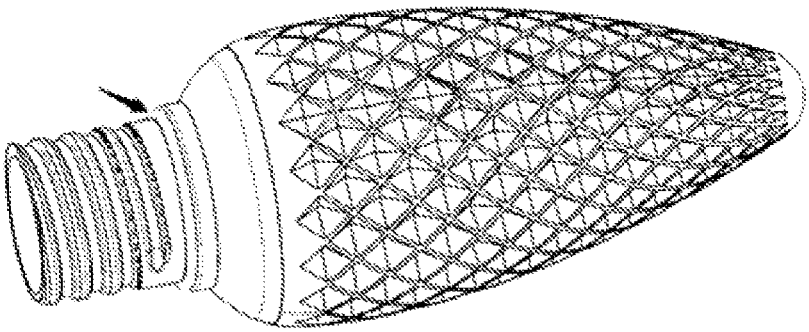
Figure 6F:
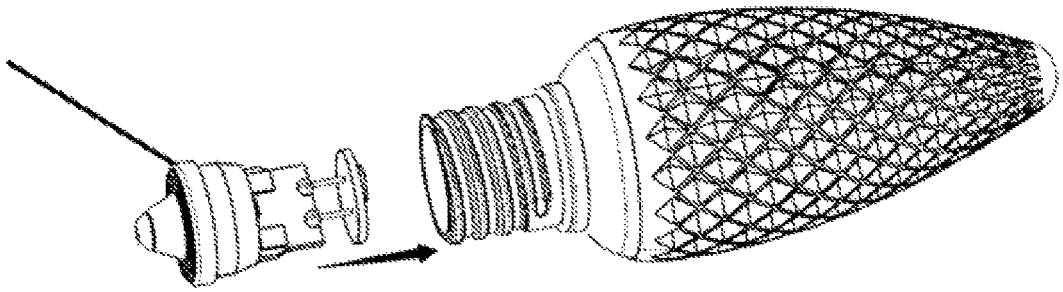
Figure 6G:
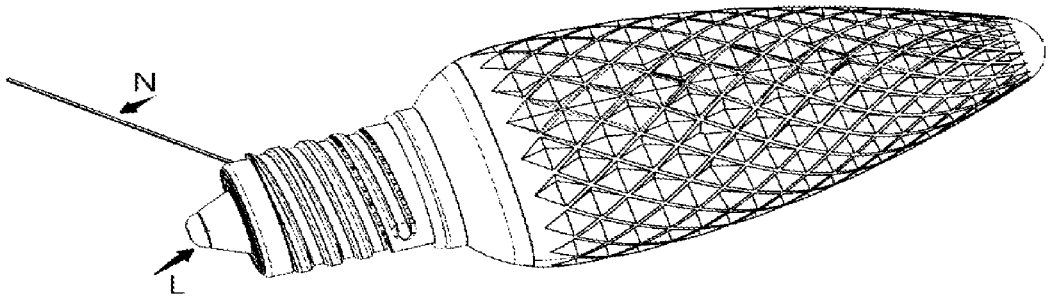
Figure 6H:
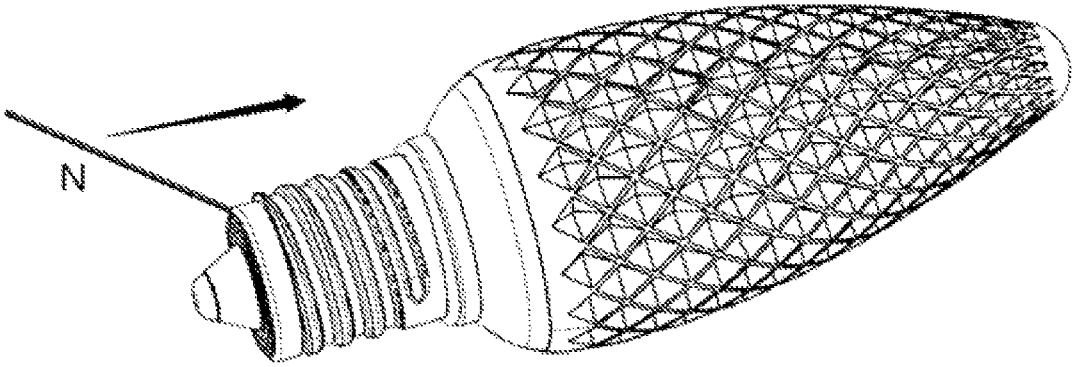
Figure 6I:
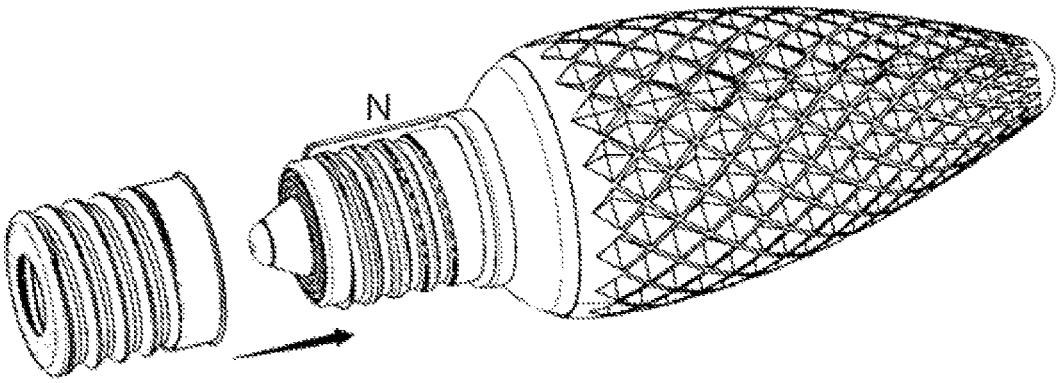

FIG. **6*a*-FIG. 6*i*** are schematic diagrams of the assembly process of the water-proof and weld-free water LED bulb of the invention.

REFERENCE SIGNS

1, cup lamp holder; 2, rivet; 21, anti-skid clamping portion; 3, silica gel plug; 3-2, hole; 3-3, slot; 3-4, fool-proof point; 4, LED lamp chip; 4-3, power board body; 41, female terminal; 411, lock piece; 42, wire; 5, first water-proof rubber ring; 6, lampshade; 61, threaded structure.

DETAILED DESCRIPTION OF THE INVENTION

It should be understood that terms such as "central", "upper", "lower", "front", "back", "left", "right", "vertical", "horizontal", "top", "bottom", "inner" and "outer" are used to indicate directional or positional relations on the basis of the accompanying drawings merely for the purpose of facilitating and simplifying the description of the invention, do not indicate or imply that devices or elements referred to must be in a specific direction or be configured and operated in a specific direction, and thus should not be construed as limitations of the invention.

To gain a better understanding of the purposes, technical solutions, and advantages of the invention, the invention will be expounded in further detail below in conjunction with the accompanying drawings and embodiments. It should be understood that the specific embodiments described herein are merely used to explain the invention, and are not intended to limit the invention.

The technical solution of the invention will be explained below with reference to specific embodiments.

Referring to FIG. 1-FIG. 4, the invention provides a water-proof and weld-free LED bulb, comprising:

A fixing structure and a water-proof structure, wherein the fixing structure is composed of a rivet 2 and a female terminal 41, an anti-skid clamping portion 21 is disposed at the top of the rivet 2, and movable lock pieces 411 are disposed on two sides of the female terminal 41; and the water-proof structure is composed of a first water-proof rubber ring 5 and a silica gel plug 3, a hole 3-2 is formed in the middle of the silica gel plug 3, the rivet 2 penetrates through the hole 3-2 in the silica gel plug 3, and the anti-skid clamping portion 21 stretches out of the other end of the hole 3-2 and is clamped on and connected to the female terminal 41.

In a preferred embodiment, the number of the movable lock pieces 411 is two, and the two movable lock pieces 411 are arranged symmetrically; after being inserted into a gap between the two movable lock pieces 411, the anti-skid clamping portion 21 will be unlikely to retreat from the gap, so that the rivet 2, the silica gel plug 3 and a power board body 4-3 are tightly connected, and a good electrical connection between the rivet 2 and the female terminal 41 is guaranteed.

In this embodiment, the water-proof and weld-free LED bulb further comprises a cup lamp holder 1, an LED lamp chip 4 and a lampshade 6, wherein one end of the bottom of the LED lamp chip 4 is connected to a wire 42, and a threaded structure 61 is disposed at the bottom of the lampshade 6.

Specifically, the cup lamp holder 1 is used for accommodating the silica gel plug 3, and the power board body 4-3, together with the LED lamp chip 4, is inserted into a slot 3-3 of the silica gel plug 3 to be fixed.

It should be noted that the rivet 2 and the lock pieces 411 are assembled to form a wire electrode of the LED bulb, and the wire 42 is used as another electrode, so that the two electrodes of the LED bulb are formed.

Furthermore, the female terminal 41 is disposed at the bottom of the LED lamp chip 4, and the silica gel plug 3 is arranged between the rivet 2 and the LED lamp chip 4. Wherein, the rivet 2 penetrates through the hole 3-2 in the middle of the silica gel plug 3 to be connected to the lock pieces 411 located on the power board body 4-3, and the LED lamp chip 4 is welded on the power board body 4-3.

Furthermore, the first water-proof rubber ring 5 is disposed around the bottom of the lampshade 6.

Furthermore, the water-proof and weld-free LED bulb further comprises a second water-proof rubber ring 3-1, wherein a top surface of the second water-proof rubber ring 3-1 is flat, a bottom surface of the second water-proof rubber ring 3-1 is provided with multiple circular water-proof protrusions, the top surface of the second water-proof rubber ring 3-1 is attached to the silica gel plug 3, and the bottom surface of the second water-proof rubber ring 3-1 is attached to the bottom of the cup lamp holder 1. The multiple circular water-proof protrusions on the bottom surface of the second water-proof rubber ring 3-1 have a multiple seal effect on a round hole reserved in the cup lamp holder 1, so that rainwater will not enter the cup lamp holder 1 via the round hole reserved in the cup lamp holder 1. In addition, the second water-proof rubber ring 3-1 may be integrated with the silica gel plug 3.

Furthermore, the rivet 2, the silica gel plug 3 and the LED lamp chip 4 are mounted in the lampshade 6, and the cup lamp holder 1 is mounted on the threaded structure 61 at the bottom of the lampshade 6.

Furthermore, the diameter of the silica gel plug is slightly greater than the caliber of the lampshade 6, and the diameter of the hole formed in the silica gel plug 3 is slightly smaller than that of the rivet 2, so that a sealing structure is formed.

In this solution, glue is smeared between the cup lamp holder 1 and the threaded structure 61 of the lampshade 6.

In this embodiment, the cup lamp holder 1, the rivet 2, the silica gel plug 3, the LED lamp chip 4, the first water-proof rubber ring 5 and the lampshade 6 are sequentially assembled, and weld-free assembly is realized by means of the rivet 2 and the female terminal 41, as well as the silica gel plug 3 and the threaded structure 61 arranged at the bottom of the lampshade 6, so that the productivity is greatly improved, and compared with solder, the rejection rate is drastically decreased; and the overall water-proof performance is stable through the cooperation of the silica gel plug 3 and the first water-proof rubber ring 5, as well as the glue smeared between the lampshade 6 and the cup lamp holder 1.

Furthermore, the water-proof and weld-free LED bulb further comprises the power board body 4-3, wherein the LED lamp chip 4 is welded on the power board body 4-3, the wire 42 is also welded on the power board body 4-3, the slot 3-3 corresponding to the power board body 4-3 in shape is formed in the top of the silica gel plug 3, and the power board body 4-3 is inserted into the slot 3-3 to be fixed.

Furthermore, a fool-proof point 3-4 is disposed at the top of the silica gel plug 3 and is located below the slot 3-3. The power board body 4-3 can be quickly and accurately inserted into the slot 3-3 by means of the fool-proof point 3-4, so the assembly efficiency is greatly improved.

Design Features of the Structure of the Soft Plug:

1: Multiple water-proof rubber rings 3-1 are designed at the bottom.

2: The inner diameter of the hole 3-2 in which the rivet 21 is inserted is slightly smaller than the diameter of the rivet, so that the rivet 21 can be tightly inserted into the hole 3-2 to guarantee the water-proof performance.

3: The slot 3-3 corresponds to a power board in size, so that the assembled structure is stable.

4: The fool-proof point 3-4 guarantees the assembly accuracy.

Refer to FIG. 6*a*-FIG. 6*i* which are schematic diagrams of the assembly process of the invention:

1: Referring to FIG. 6*a* and FIG. 6*b*, first of all, the rivet is tightly inserted into the soft plug, so that the water-proof performance is guaranteed; the structure formed after the rivet is inserted into the soft plug is shown in FIG. 6*b;*

2: Referring to FIG. 6*c* and FIG. 6*d*, the power board is inserted into the soft plug to enable the head of the rivet to be inserted into the SMT female terminal, and the structure formed after the power board is inserted into the soft plug is shown in FIG. 6*d*. When the rivet and the female terminal are assembled, the anti-skid clamping portion at the top of the rivet can enter the gap between the movable lock pieces on the two sides of the female terminal to be fixed and can be clamped by the lock pieces to be effectively prevented from retreating from the lock pieces, and the lock pieces are in good electrical contact with the anti-skid clamping portion.

Figure 1:
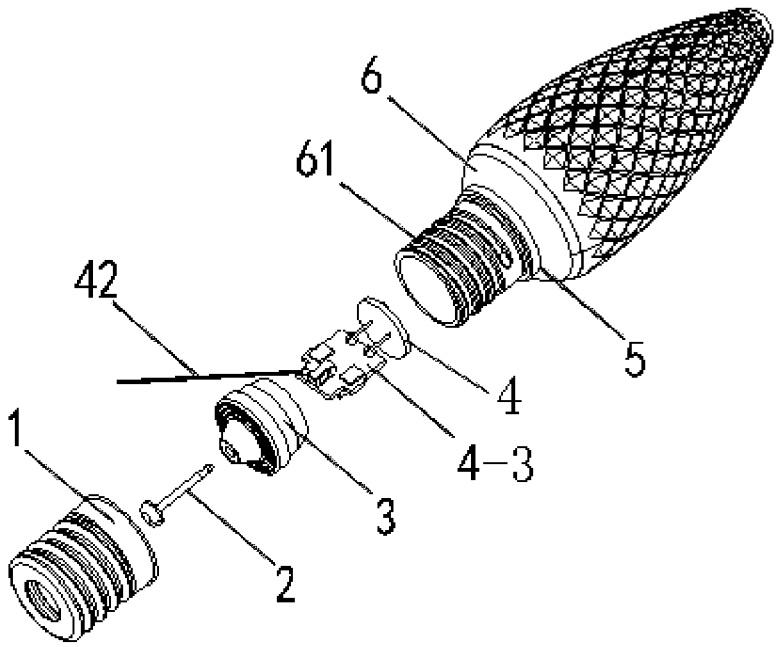
FIG. 1 is a structural view of a water-proof and weld-free LED bulb provided by the invention.
Figure 2:
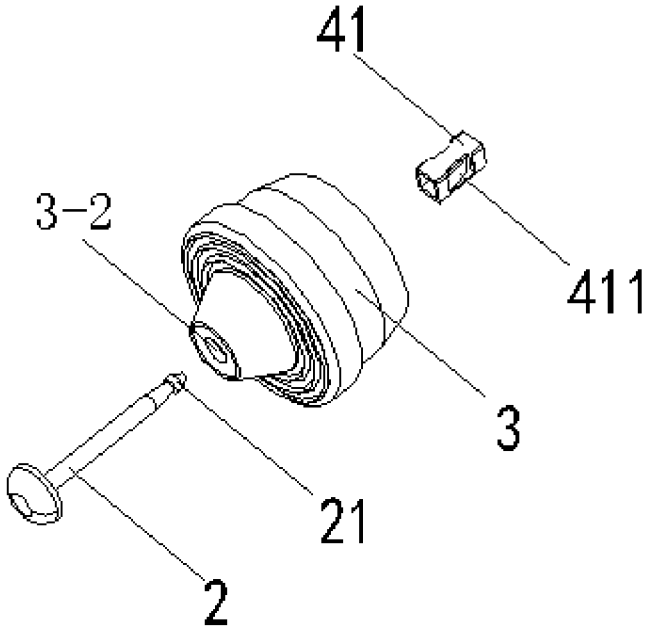
FIG. 2 is a partial structural view of the water-proof and weld-free LED bulb.
Figure 3:
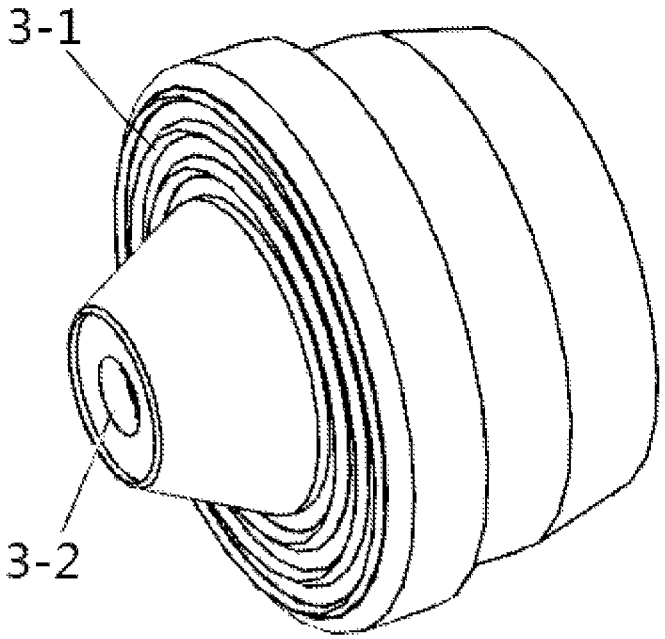
FIG. 3 is a schematic diagram of a silica gel plug in one direction.
Figure 4:
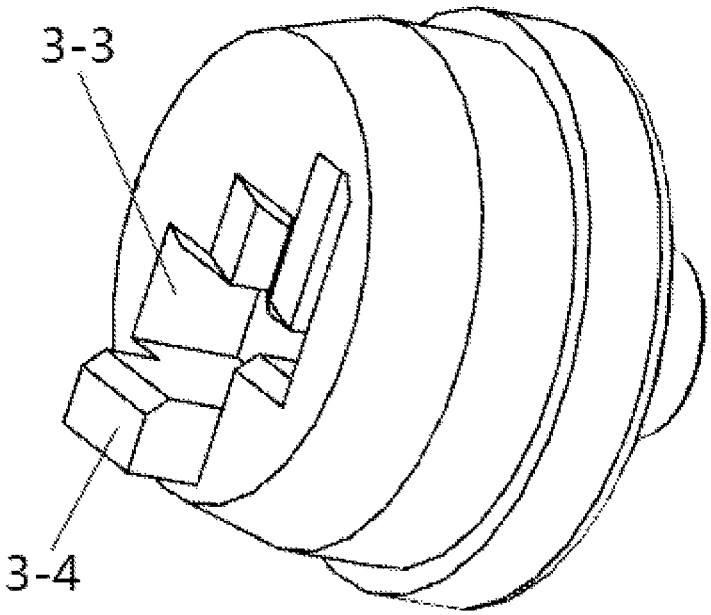
FIG. 4 is a schematic diagram of the silica gel plug in another direction.
Figure 5:
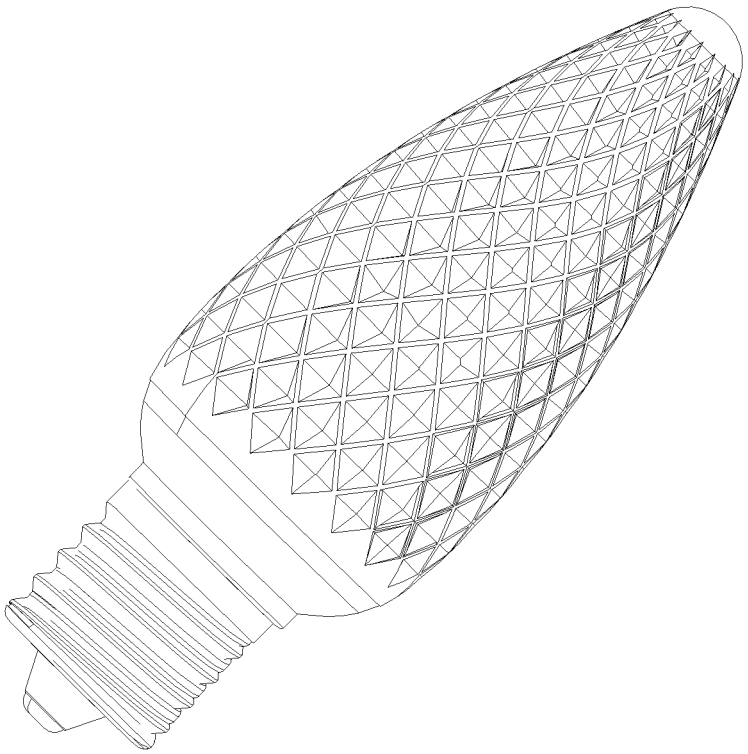
FIG. 5 is an overall view of the water-proof and weld-free LED bulb.

3: Referring to FIG. 6*e*, the first water-proof rubber ring is disposed around the lampshade;

4: Referring to FIG. 6*f*-FIG. 6*g*, the semi-finished product is inserted into a lamp housing. The semi-finished product is tightly inserted into the lamp housing, so that the water-proof performance is guaranteed, and the silica gel plug and an inlet of the lamp housing are sealed; the effect realized after assembly is shown in FIG. 6*g*, wherein L/N is a power input terminal;

5: Referring to FIG. 6*h*-FIG. 6*i* and FIG. 5, the wire N is bent toward the lamp housing to facilitate the assembly of a finished product. The cup lamp holder smeared with glue is assembled in the lamp housing and is then rotated clockwise to be seamlessly connected to the lamp housing. The schematic diagram of the structure formed after assembly is shown in FIG. 5.

Although the invention has been described above with reference to several typical implementations, it should be understood that the terms in the above description are interpretive and illustrative rather than being restrictive. It should be appreciated that the invention can be specifically implemented in different forms without departing from the spirit or principle of the invention, and these implementations are not limited to any aforesaid details and should be broadly interpreted within the spirit and scope defined by the appended claims. Thus, all variations and transformations within the scope of the claims or their equivalents should be covered by the appended claims.

What is claimed is:

1. A water-proof and weld-free LED bulb, comprising:

a fixing structure composed of a rivet and a female terminal, wherein an anti-skid clamping portion is arranged at a top of the rivet, and movable lock pieces are arranged on two sides of the female terminal;

a water-proof structure composed of a first water-proof rubber ring and a silicone plug, wherein a hole is formed in a middle of the silicone plug, the rivet penetrates through the hole in the silicone plug, and the anti-skid clamping portion stretches out of another end of the hole and is clamped on and connected to the female terminal;

a cup lamp holder, an LED lamp chip and a lampshade, wherein one end of a bottom of the LED lamp chip is connected to a wire, and a threaded structure is arranged at a bottom of the lampshade;

the first water-proof rubber ring is disposed around the bottom of the lampshade;

a second water-proof rubber ring, wherein a top surface of the second water-proof rubber ring is flat, a bottom surface of the second water-proof rubber ring is provided with multiple circular water-proof protrusions, the top surface of the second water-proof rubber ring is attached to the silicone plug, and the bottom surface of the second water-proof rubber ring is attached to a bottom of the cup lamp holder.

2. The water-proof and weld-free LED bulb according to claim 1, wherein the female terminal is arranged at the bottom of the LED lamp chip, and the silicone plug is arranged between the rivet and the LED lamp chip.

3. The water-proof and weld-free LED bulb according to claim 1, wherein the rivet, the silicone plug and the LED lamp chip are mounted in the lampshade, and the cup lamp holder is mounted on a threaded structure at the bottom of the lampshade.

4. The water-proof and weld-free LED bulb according to claim 3, wherein glue is smeared between the cup lamp holder and the threaded structure of the lampshade.

5. The water-proof and weld-free LED bulb according to claim 1, wherein a diameter of the silicone plug is slightly greater than a caliber of the lampshade, and a diameter of the hole formed in the silicone plug is slightly smaller than that of the rivet.

6. The water-proof and weld-free LED bulb according to claim 1, further comprising a power board body, wherein an LED lamp chip is welded on the power board body, a wire is also welded on the power board body, a slot corresponding to the power board body in shape is formed in a top of the silicone plug, and the power board body is inserted into the slot to be fixed.

7. The water-proof and weld-free LED according to claim 6, wherein a fool-proof point is arranged at the top of the silicone plug and is located below the slot.

* * * * *